United States Patent [19]

Fitzgerald et al.

[11] 4,214,389

[45] Jul. 29, 1980

[54] APPARATUS AND METHOD FOR IGNITION IDENTIFICATION OF INTERNAL COMBUSTION ENGINES

[76] Inventors: Harry H. Fitzgerald, 16023 47th Ave. S., Seattle, Wash. 98188; Robert G. Fitzgerald, Box 6071, Odessa, Tex. 79760

[21] Appl. No.: 839,398

[22] Filed: Oct. 4, 1977

[51] Int. Cl.[2] ..... G09F 3/00

[52] U.S. Cl. ..... 40/316; 40/2 R

[58] Field of Search ..... 40/600, 621, 324, 316, 40/11 R, 2 R

[56] References Cited

U.S. PATENT DOCUMENTS

| | | | |
|---|---|---|---|
| 2,761,413 | 9/1956 | Breer | 40/621 X |
| 3,561,066 | 2/1971 | Osteen | 40/11 X |
| 3,861,068 | 1/1975 | Zygmunt | 40/316 X |
| 3,977,104 | 8/1976 | Stupar | 40/316 X |

FOREIGN PATENT DOCUMENTS

| | | | |
|---|---|---|---|
| 1110710 | 8/1975 | Fed. Rep. of Germany | 40/316 X |
| 11352 | of 1906 | United Kingdom | 40/324 |

*Primary Examiner*—Louis G. Mancene
*Assistant Examiner*—Wenceslao J. Contreras
*Attorney, Agent, or Firm*—Nicolaas DeVogel

[57] ABSTRACT

An apparatus and method for coding each distributor socket, each corresponding ignition cable at the socket end and at the spark plug end, and each corresponding spark plug location. Application of the apparatus and method will permit the complete temporary separation of the ignition cables, the changing of spark plugs, replacement of the distributor cap, engine tune-up and check-out procedures while maintaining correlation therein between and thus preventing foul-up of the firing order of the internal combustion engine. The apparatus contains three sets of numbered clips and one set of numbered magnets which are respectively utilized for identification from each distributor socket via its ignition cable to its proper spark plug location.

1 Claim, 5 Drawing Figures

FIG. 1
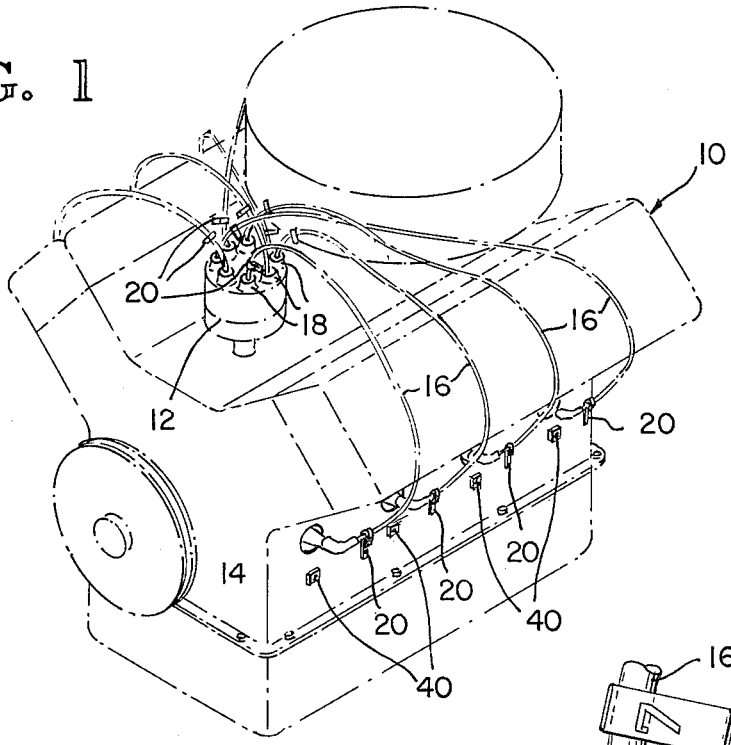
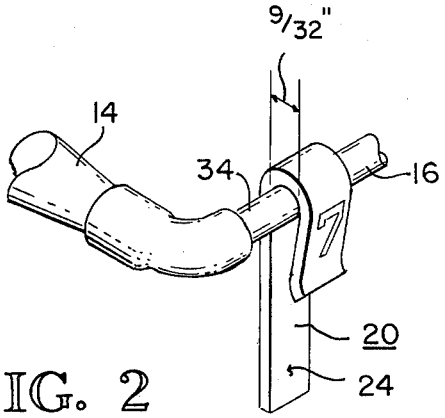
FIG. 2
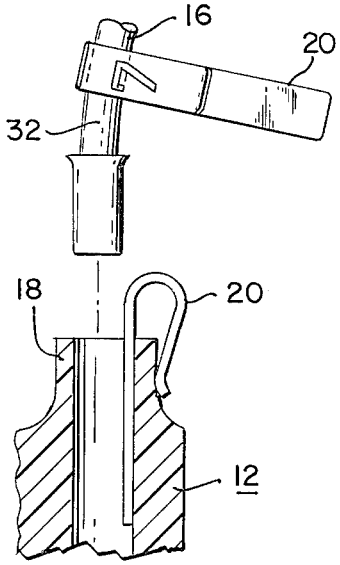
FIG. 3
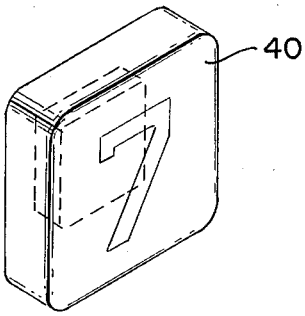
FIG. 4
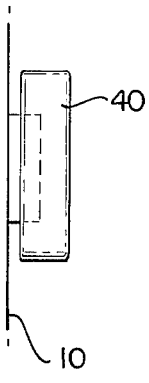
FIG. 5

APPARATUS AND METHOD FOR IGNITION IDENTIFICATION OF INTERNAL COMBUSTION ENGINES

BACKGROUND OF THE INVENTION

1. Field of the Invention

The present invention relates to coding systems for the external ignition components of internal combustion engines and more particularly to a method and apparatus for identifying each distributor socket, both corresponding ignition cable end portions and its proper spark plug.

2. Brief Description of the Prior Art

Because the replacement of ignition cables or the disconnection thereof is a frequently reoccuring task, as well as the removal of spark plugs during tune-up or check-out, care should be taken that the ignition cable spark plug and socket connections, etc., are connected in the same proper order so that the firing sequence of the internal combustion engine is not disrupted. Wrong connections of the external ignition components would result in a harmful engine operation. However, it is a well known fact that many mistakes are made by mechanics and amateur mechanics since the task of keeping the cables and socket connections in its correct connection to the spark plugs is cumbersome and confusion is easily possible since many other cables, tubing and wires are arranged in the same area. Accordingly, various devices have been proposed to keep the ignition cables in correct placement between its distributor socket and spark plug.

For instance, U.S. Pat. No. 3,861,068 discloses a ring-shaped device which provides identification for each distributor socket by mounting the coded ring about the distributor cap next to the sockets. The invention further refers to the additional coding of one of the ignition cables in correlation with the coding of the distributor cap by the ring-shaped device. Undoubtedly, this system will aid in providing the proper connecting procedure at the distributor side of the engine, however, on large engines, in particular the ones used in the deluxe automobiles, where many additional cables, tubes, electrical and mechanical components are randomly arranged, such as air conditioners, windshield washing devices, two-speed and other power components, it is very hard to follow the ignition cable from one end to the other end. In addition, since the distributor is not always mounted on top of the engine but sometimes at a remote corner in the engine environment, the cables run in various directions underneath and above various larger components, being hidden from direct observation by the mechanic while crisscrossing to different directions. Furthermore, distributor caps come in all sizes and shapes and thus the ring-shaped devices as disclosed by U.S. Pat. No. 3,861,068 has to come in all sizes and one device cannot be utilized for every existing engine distributor cap arrangement. Also, if one intends to code the ignition components in the order of the firing sequence of the engine, a different ring has to be manufactured for each different engine.

Accordingly, it will be obvious to anyone skilled in the art that the above-mentioned U.S. Pat. No. 3,861,068 is an improvement, however includes various limitations as to its use.

In the field of marking devices, the most pertinent art has been found in U.S. Pat. Nos. 3,354,564 and 3,977,104. Both inventions relate to a clip device and the latter one mentioned is utilized in the automotive field for marking or identifying the ignition cables of an internal combustion engine. Neither one of the disclosed clips can be used at the distributor socket and the cable contact end portion. Also, both clipping devices are complicated indesign and are uneconomic for manufacturing purposes.

In summary, it appears that the prior art has provided devices which are operable for identifying ignition systems part way, but still lack reliability and there is still a continuing need to seek improvements with regard to that reliability, multiple use of a device or system, simplicity, as well as the economics of manufacturing and the commercial or sales potential.

It is the intention of the present disclosed invention to overcome the rejections and difficulties presented by the prior art as explained hereabove.

SUMMARY OF THE INVENTION the present invention comprises three sets of similarly numbered clips and one set of numbered magnet indicias. The coding or numbering of the ignition components is accomplished at each external electrical ignition connection which occurs from the distributor socket to the spark plug ignition cable connection. The clips being utilized are very simple in design and are easy to manufacture from one elongated sheet of heat resistant material which is formed in one procedure and thereafter cut or sliced into many clips. The clips are utilized to mark all the sockets of the distributor cap and also the ignition cables since the clips are provided with a spring tension and have an approximate $\frac{3}{4}$ circle opening that fits the ignition cable diameter. Two identically numbered clips are attached at each end portion of each ignition cable.

The magnet indicias are placed next to the spark plug to identify the connection of the spark plug end.

It will be virtually impossible to misconnect any connection either to the spark plugs or to the distributor sockets when the present invention is reduced to practice during engine tune-up, spark plug replacement, check-up procedures and other engine rebuild or repair procedures.

The coding arrangement of the ignition components can be accomplished in the corresponding firing order or any other preferred order or arrangement. Replacement of the clips and the magnets from the external ignition components from one engine to another can be easily accomplished.

In the preferred embodiment of the present invention, the apparatus consists of eight identifiers, clips and magnets for the purpose of attaching to various ignition system components to maintain correlation during ignition parts replacement or tune-up procedures on internal combustion engines of up to eight cylinders. there is a total of four sets divided into three sets having eight clips and one set having eight magnets, all numbered consecutively. The clips are provided with means for attachment to the distributor cap socket, each end of the ignition cable and the magnet indicia for attachment to the corresponding spark plug location. Preferably, the magnet identifiers, used to mark the plug location, are attached to the valve cover or other approximate ferrous metal parts adjacent the spark plug. The four sets of identifiers are each numbered from one through eight for use on any ignition system up to that number of cylinders. Each set of identifiers may, but need not necessarily, consist of different colors. The material used for the identifiers may be of any conventional plastic material which is oil, gas, and temperature resistant, having slightly biased or resilient properties for clipping onto the wires and the distributor socket holes. The identifiers may be reusable from one operation to the next and the total apparatus in the preferred embodiment comprises thirty-two identifiers which are suggested to be sold in a package kit form inclusive of an instruction guide, for user consumption.

Accordingly, it is the primary object of the present invention to provide for a method and apparatus for identifying each corresponding electrical connection of the external ignition components of an internal combustion engine, to preserve the correct firing sequence thereof, by coded or numbered means.

It is another object of the present invention to provide for an apparatus which can be utilized on most internal combustion engines and can be economically manufactured.

Other objects and advantages of the present invention will become apparent from the following specification when considered in the light of the attached drawings.

BRIEF DESCRIPTION OF THE DRAWINGS

FIG. 1 is a perspective illustration of a typical engine and its external ignition components which are provided with the apparatus and system of the present invention.

FIG. 2 is a side view of the coding clip.

FIG. 3 is a front view of the coding clip.

FIG. 4 is a side view of the magnet indicia.

FIG. 5 is a front view of the magnet indicia.

DESCRIPTION OF THE INVENTION

Referring to the drawings in detail, like reference characters are utilized to indicate like parts throughout the several figures.

In FIG. 1 there is illustrated an internal combustion engine 10 which is provided with a distributor 12, spark plugs 14 and ignition cables 16. The distributor 12 is provided with sockets 18 and the ignition cables 16 are connected between the sockets 18 and the spark plugs 14. As discussed before, recent automotive engine arrangements, in particular those where a confined space is available or those of the deluxe automobiles, the distributor is normally not centered on top of the engine as has been conventionally practiced, but in a forward or behind-the-engine side corner location. In addition, additional equipment such as windshield wipers, spray containers, air conditioners, battery, speed control and power and brake and power steering components are located about the engine. This results in long ignition wires which cannot be viewed from one angle and which are led in various directions toward the spark plugs. The professional or amateur mechanic has to follow each ignition cable through this confusion or spaghetti-type mess in order to find the beginning and the end of the same ignition cable. This may lead to mistakes and result in harmful engine operations. Accordingly, the coding of each end of the ignition cable 16 and the coding of the spark plug 14 location will result in a reliable, error-free correlation system, being an improvement to the existing systems. Therefore, as illustrated in FIG. 1, one has provided clips 20 at the socket 18 and at the socket end portion 32 of the ignition cable 16 and on the spark plug end portion 34 of the ignition cable 16. The clip 20, which is preferably manufactured from a gas and oil resistant material and also of a material that has resilient properties and preferably can stand the engine temperatures, which materials are available in the prior art such as the particular hard rubber type or plastic type materials. Thus, the complete system can stay on the engine permanently if one wishes, however, since the clips and the magnets will become dirty and are easily removable, it appears simpler to utilize the system only during engine work, thus, to install and remove the clips and magnets prior and after engine work is performed, respectively.

As illustrated in FIG. 2, the clip 20 has an extended flat and relatively thin, straight leg portion 24 which may be placed between the ignition cable socket end portion 32 and the socket interior 18 so that a tight fitting relationship or mounting of the clip to the socket is established, however, one would need this mounting only when the system is permanently installed. In general, the clip will be inserted when the cable is removed from the socket and simultaneously the cable is clipped with a similar identification prior to engine work. The coding or the identification on the ignition cable 16 at the socket end portion 32 and the spark plug end portion 34 is provided by the same clip 20, however, the attachment is now provided by the resilient two legs which are clamped about the cable 16 circumference. As indicated, the clip construction is simple and comprises the straight leg portion 24 as described which is curved in a more than 180° circular direction which has an internal diameter or width of 9/32 inches being slightly smaller than the standard ignition cable diameters used in the automobile industry. In addition to the identification of the ignition cable 16 at two locations and the socket 18, the electrical connection of the ignition cable 16 with the spark plug 14 has to be marked or coded. This coding is accomplished by a magnet indicia 40 which is illustrated in FIGS. 4 and 5. This component or magnet 40 has relatively small dimensions and can be attached to the engine adjacent the spark plug 14 or on any ferrous metal or part in the immediate location of the spark plug 14.

The complete apparatus of the present invention includes preferably three sets of eight consecutively numbered clips 20 and one set of eight consecutively numbered magnet indicia 40. It would be preferred, but it is not necessary, that the three groups of eight clips are of different colors so that the clips used on the socket and the clips used on the ignition cable socket end portion are of different color groups as well as the clips used on the spark plug end portion of the ignition cable. For instance, green, blue, and red. As for the numbering of the system, one could use a consecutive order by just going around the engine from right to left or the distributor sockets in one circular motion and number one through four, or six, or eight, depending on the total of cylinders, but a person could also number in the order of the engine firing sequence.

It is the intention of the inventor to manufacture the present apparatus in a kit form with the necessary instructions for sale purposes. As for the numbering of the clips and magnets, any molded, pasted on, or imprinted ink-type of numbering will suffice.

Additional embodiments of the invention in this specification will occur to others, and, therefore, it is intended that the scope of the invention be limited only by the appended claims and not by the embodiment described hereinabove. Accordingly, reference should be made to the following claims in determining the full scope of the invention.

Now, therefore, we claim:

1. A universal ignition identification apparatus for engines having a plurality of cylinders, a distributor, and ignition cables, comprising in combination:

(a) a first plurality of clips, each having a two-legged, spring-biased portion for attachment to said engine distributor by insertion of at least one leg into each said distributor sockets, (b) a second plurality of clips, each having a two-legged, spring-biased portion for resilient attachment about each said ignition cables near each said cable distributor end portion, (c) a third plurality of clips, each having a two-legged, spring-biased portion for resilient attachment about each said ignition cables near each said cable cylinder end portion, (d) said two-legged clips of said first, second and third plurality are identically shaped clips arranged in three consecutively numbered sets and wherein each clip is provided with at least one thin and flat extending leg portion made from a thermo-plastic material, (e) a plurality of magnet indicators for magnetic attachment at said engine at a location adjacent each said cylinder, (f) said first, second, third plurality of clips and said plurality of magnets, each being consecutively numbered, and (g) each said identically numbered clips and said identically numbered magnet corresponding to said engine associated firing cylinder number, whereby constant ignition identification of said engine cylinder/ignition sequence is maintained for external ignition component replacement.

* * * * *